US006810557B2

(12) United States Patent
Hansen et al.

(10) Patent No.: US 6,810,557 B2
(45) Date of Patent: Nov. 2, 2004

(54) CYCLONE SEPARATOR WITH VACILLATING DEBRIS INHIBITOR

(75) Inventors: Samuel N. Hansen, Jenison, MI (US); David E. McDowell, Grand Rapids, MI (US); Lindsay Michelle Swartz, Rockford, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 228 days.

(21) Appl. No.: 10/058,514

(22) Filed: Jan. 28, 2002

(65) Prior Publication Data

US 2004/0154126 A1 Aug. 12, 2004

(51) Int. Cl.[7] ..... A47L 9/16

(52) U.S. Cl. ..... 15/353; 15/352; 55/426; 55/429; 55/459.1; 55/DIG. 3

(58) Field of Search ..... 15/353, 352; 55/337, 55/429, 459.1, DIG. 3, 425, 426

(56) References Cited

U.S. PATENT DOCUMENTS

| | | | | |
|---|---|---|---|---|
| 1,938,849 A | | 12/1933 | Maxim et al. | |
| 2,071,975 A | | 2/1937 | Holm-Hansen et al. | |
| 2,171,248 A | | 8/1939 | Van Berkel | |
| 2,385,745 A | | 9/1945 | Vogt | |
| 3,675,401 A | | 7/1972 | Cordes | 55/394 |
| 3,955,948 A | | 5/1976 | Campolong | 55/394 |
| 6,129,775 A | | 10/2000 | Conrad et al. | 55/337 |
| 6,171,356 B1 | | 1/2001 | Twerdun | 55/337 |
| 6,221,134 B1 | | 4/2001 | Conrad et al. | 95/271 |
| 6,228,151 B1 | | 5/2001 | Conrad et al. | 95/271 |
| 6,231,645 B1 | | 5/2001 | Conrad et al. | 95/271 |
| 6,475,256 B2 | * | 11/2002 | Matsubara et al. | 55/337 |
| 6,579,334 B2 | * | 6/2003 | Oh et al. | 55/459.1 |
| 6,607,575 B2 | * | 8/2003 | Oh et al. | 55/426 |
| 6,616,721 B2 | * | 9/2003 | Oh | 55/429 |
| 6,623,539 B2 | * | 9/2003 | Lee et al. | 55/426 |
| 2001/0010189 A1 | | 8/2001 | Conrad et al. | 95/271 |

* cited by examiner

*Primary Examiner*—Theresa T. Snider
(74) *Attorney, Agent, or Firm*—McGarry Bair PC

(57) ABSTRACT

The invention relates to a cyclonic dirt separator comprising a dirt-collection assembly including a dirt tank having an inlet aperture and an outlet aperture, a cyclonic separator, at least one filter element, and a suction source fluidly connected with the dirt collection assembly. In one embodiment, the cyclonic dirt separator includes a separator plate cooperating with the housing to form a toroidal region of the dirt tank for aiding in the separation of dirt from a suction airstream developed by the suction source. The separator plate has an outer diameter smaller than the inner diameter of the dirt tank, creating a gap between the outer edge of the separator plate and the inner wall of the dirt tank. A further embodiment includes fins projecting from a sidewall of the dirt tank, and fingers projecting from a bottom wall of the dirt tank, to reduce re-entrainment of dirt particles.

26 Claims, 5 Drawing Sheets

CYCLONE SEPARATOR WITH VACILLATING DEBRIS INHIBITOR

BACKGROUND OF THE INVENTION

1. Field of the Invention

The invention relates to suction cleaners, and in particular to a separator for a suction cleaner. In one of its aspects, the invention relates to a separator with a cyclonic airflow path to separate dirt and debris from air drawn into the cleaner. In another of its aspects, the invention relates to a separator that deposits the dirt and debris in a collection receptacle. In another of its aspects, the invention relates to a separator including structure for inhibiting the re-entrainment of debris that vacillates with upward airflows in the collection receptacle.

2. Description of the Related Art

Cyclone separators are well known. Some follow the textbook examples using frusto-conical shape separators and others use high-speed rotational motion of the air/dirt to separate the dirt by centrifugal force. Separation of the dirt/dust from the air is not difficult, but the problem of keeping the dirt separated from the airflow has not been adequately solved. There is a tendency for the separated debris to re-entrain into the airflow and thereby pass through the separator. Some minor amounts of fine dust usually do get through the cyclone and are filtered in secondary filters downstream to maximize dust removal. These filters are positioned anywhere from the cyclone exit port to the clean air exhaust port.

The U.S. Pat. No. 6,260,234 to Wright attempts to solve the re-entrainment problem by placing a main filter in the cyclonic chamber. In this case, the main filter becomes the main separator and re-entrainment becomes a non-issue. This technique is similar to the filters in utility vacuums; however this approach creates a new problem of blinding the filter. The main filter must be cleaned or replaced frequently due to poor cyclone separation and creates a customer satisfaction problem.

The U.S. Pat. No. 6,221,134 to Conrad et al. discloses another attempt to reduce re-entrainment in a cyclone separator. Conrad et al. disclose a particle-receiving chamber beneath the cyclonic fluid flow region by adding a particle-separating plate that extends across the width of the separator chamber and has a plurality of narrow slots. Even though there continues to be rotational motion in the receiving chamber, the particles find it difficult to re-entrain into the airflow. However, this technique also has a problem. Not all the dirt is small enough to pass through the slots and dirt accumulates in the slots and plugs the slots. This means that a significant amount of debris remains in the cyclonic fluid flow region and is subject to re-entrainment.

The U.S. Pat. No. 6,228,151 to Conrad et al. discloses yet another attempt to reduce re-entrainment in a cyclone separator. In this separator, a plurality of vertical radial vanes extends from the bottom of an outer wall of the separator to a central portion of the separator. A cap covers a significant portion of the inner radial length of the vanes.

The Holm-Hansen et al. U.S. Pat. No. 2,071,975 discloses a vacuum cleaner with a separate dust separator that includes a conical casing in which the dust is separated from air by centrifugal force and a dust receptacle separated from the conical casing by a plate that extends radially from the center of the separation chamber toward the wall of the conical casing. Particles that are separated from air in the conical casing pass through the annular space between the outer wall of the chamber and the outer edge of the plate and into the dust receptacle. A tubular member in the center of the conical casing is formed from four overlapping curved metal strips between which the separated air passes to exit the separator. A pair of parallel, horizontally disposed foraminous screens are mounted in the bottom of the dust receptacle to facilitate settling of the dust.

SUMMARY OF THE INVENTION

According to the invention, a vacuum cleaner comprises a housing defining a cyclonic airflow chamber for separating contaminants from a dirt-containing airstream and a cyclonic chamber inlet and an airstream outlet in fluid communication with said cyclonic airflow chamber. The vacuum cleaner includes a nozzle housing having a suction opening fluidly connected with the cyclonic chamber inlet, and an airstream suction source fluidly connected to the main suction opening and to the cyclonic airflow chamber for transporting dirt-containing air from the suction opening to the cyclonic airflow chamber. The suction source is adapted to establish and maintain a dirt-containing airstream from the suction opening to the cyclonic chamber inlet.

A dirt-collecting bin is mounted beneath the cyclonic airflow chamber and includes a bottom wall and a cylindrical sidewall. A separator plate between the cyclonic airflow chamber and the dirt-collecting bin separates the cyclonic airflow chamber from the dirt-collecting bin. The separator plate has a diameter less than a diameter of the cyclonic airflow chamber adjacent the separator plate to thereby define a gap between the separator plate and the cyclonic airflow chamber for passage of dirt separated from the dirt-containing airstream in the cyclonic airflow chamber. The passage of dirt through the gap is accompanied by an airflow having horizontal and vertical components between the gap and the bottom wall of the dirt-collecting bin, which airflow tends to entrain dirt particles therein. It is believed that this airflow may be elliptical in form.

Airflow inhibitors are present in the dirt-collecting bin to reduce the vertical component of the airflow, thereby tending to agglomerate and separate the dirt particles from the airflow.

In one embodiment, the flow inhibitors comprise at least one prong extending upwardly from the bottom wall of the dirt-collecting bin and positioned radially between a center of the dirt-collecting bin and the sidewall thereof. Preferably, the airflow inhibitors comprise a plurality of said prongs each positioned radially between a center of the dirt-collecting bin and the sidewall thereof. The prongs extend a portion of the distance between the bottom wall and the separator plate. Further, the prongs are rectangular in cross section with a long axis radially disposed in the dirt-collecting bin.

In another embodiment, the airflow inhibitors further comprise at least one fin that extends radially inwardly from the sidewall of the dirt-collecting bin. Preferably, there are two and only two fins. The fins are generally positioned vertically below the inlet. The fin or fins extend a portion of the distance between the bottom wall and the separator plate. The fin or fins extend between 40% and 60% of the distance between the bottom wall and the separator plate. Generally, the fins have a radial dimension between 2% and 10% of the radius of the dirt-collecting bin, preferably, between 3% and 6% of the radius of the dirt-collecting bin. In a specific embodiment, the fins have a radial dimension equal to about 4% of the radius of the dirt-collecting bin.

DESCRIPTION OF THE PREFERRED EMBODIMENT

Figure 1:
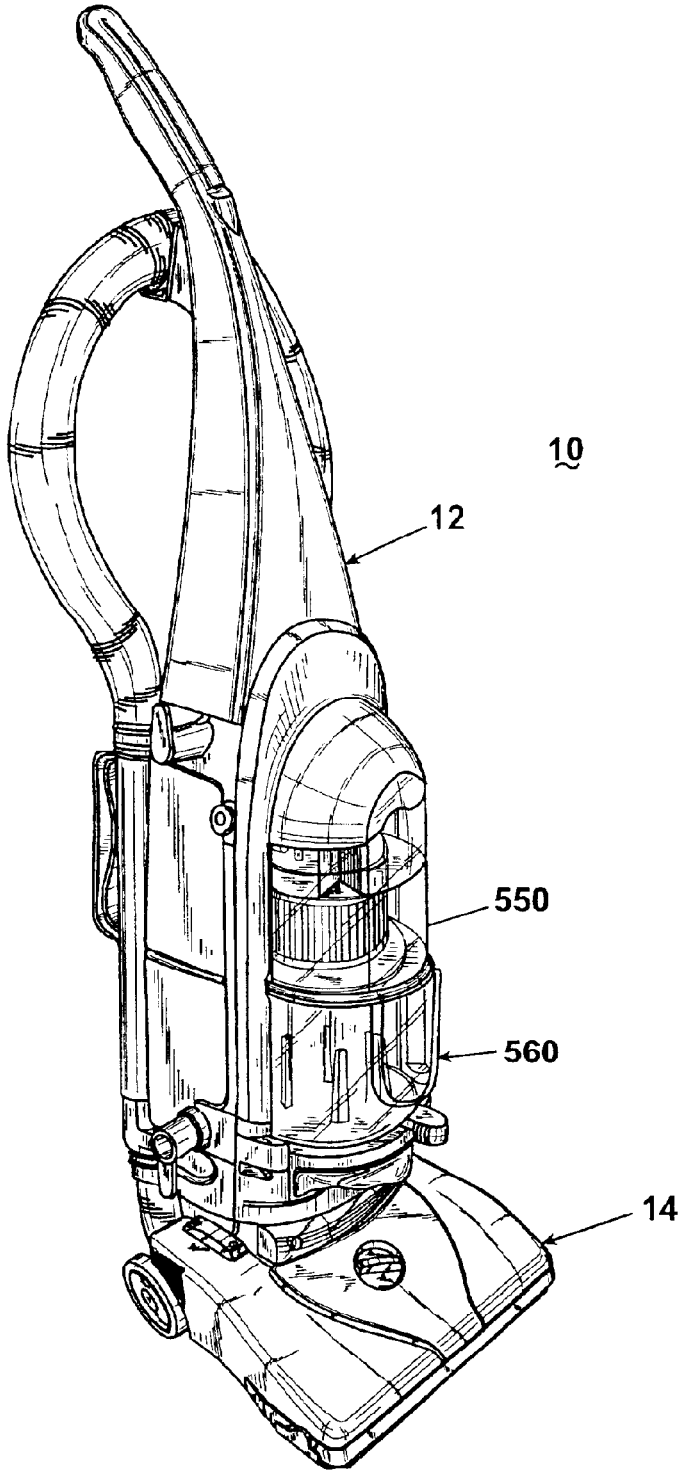
FIG. 1 is a perspective view of an upright vacuum cleaner with cyclone separator according to the invention.

An upright vacuum cleaner 10 with cyclonic dirt separator 550 and dirt cup 560 according to the invention is shown in FIG. 1, comprising an upright handle 12 pivotally mounted to a nozzle base 14. The upright handle 12 mounts the cyclonic dirt separator 550 and dirt cup 560 according to the invention.

Figure 2:
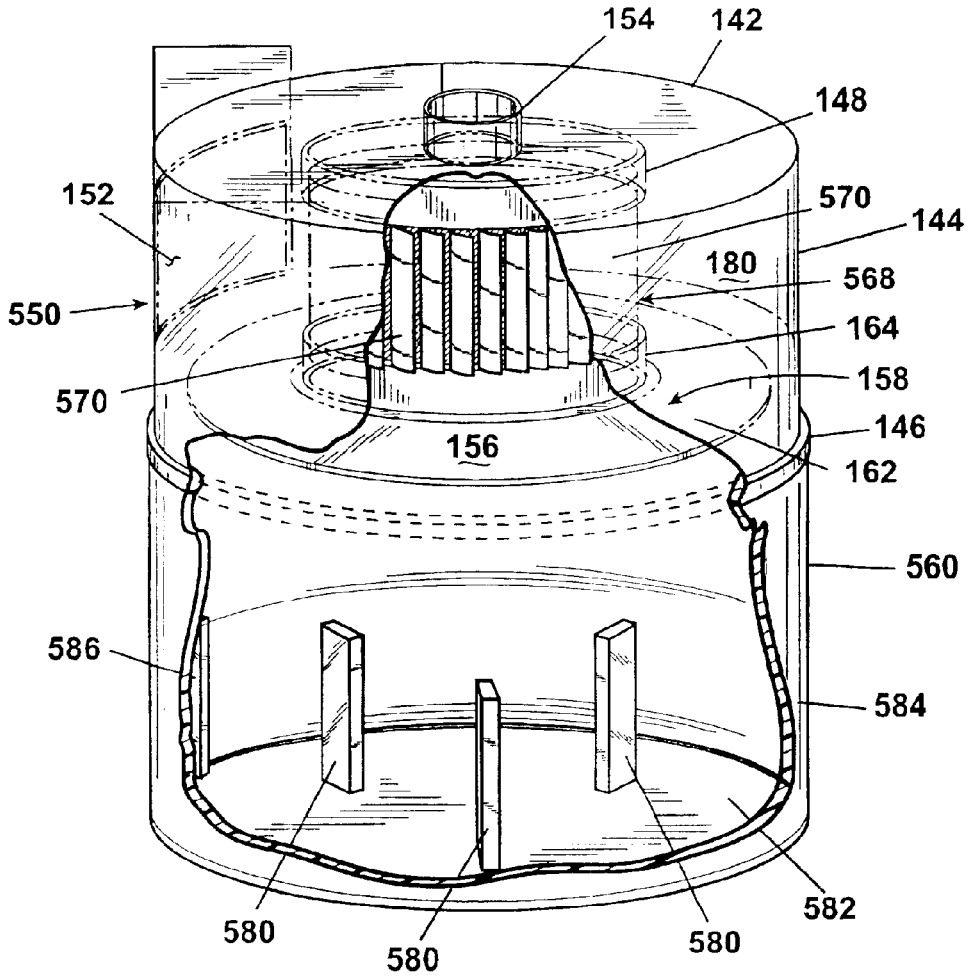
FIG. 2 is a cut-away perspective view of the cyclonic separator of FIG. 1.

Referring to FIG. 2, cyclonic dirt separator and dirt cup assembly 51 according to the invention comprises a cylindrical cyclone separator 550 having an upper wall 142 and a sidewall 144, the sidewall 144 terminating in a lower offset lip 146. An annular collar 148 depends from upper wall 142, the collar 148 being centered in the cylindrical cyclone separator 550. An exhaust outlet 154 in the upper wall 142 and within the annular collar 148 is fluidly connected with a suction source (see FIG. 3). Sidewall 144 further includes a tangential air inlet 152 aligned proximate the upper wall 142 for generating a tangential airflow in the separator 550 parallel to the upper wall 142.

The cyclonic dirt separator 550 further comprises a filter assembly 568. The filter assembly 568 comprises a cylindrical arrangement of louvers 570 depending from the collar 148 that depends from upper wall 142 of the chamber 150, and terminating in a lower annular collar.

Figure 3:
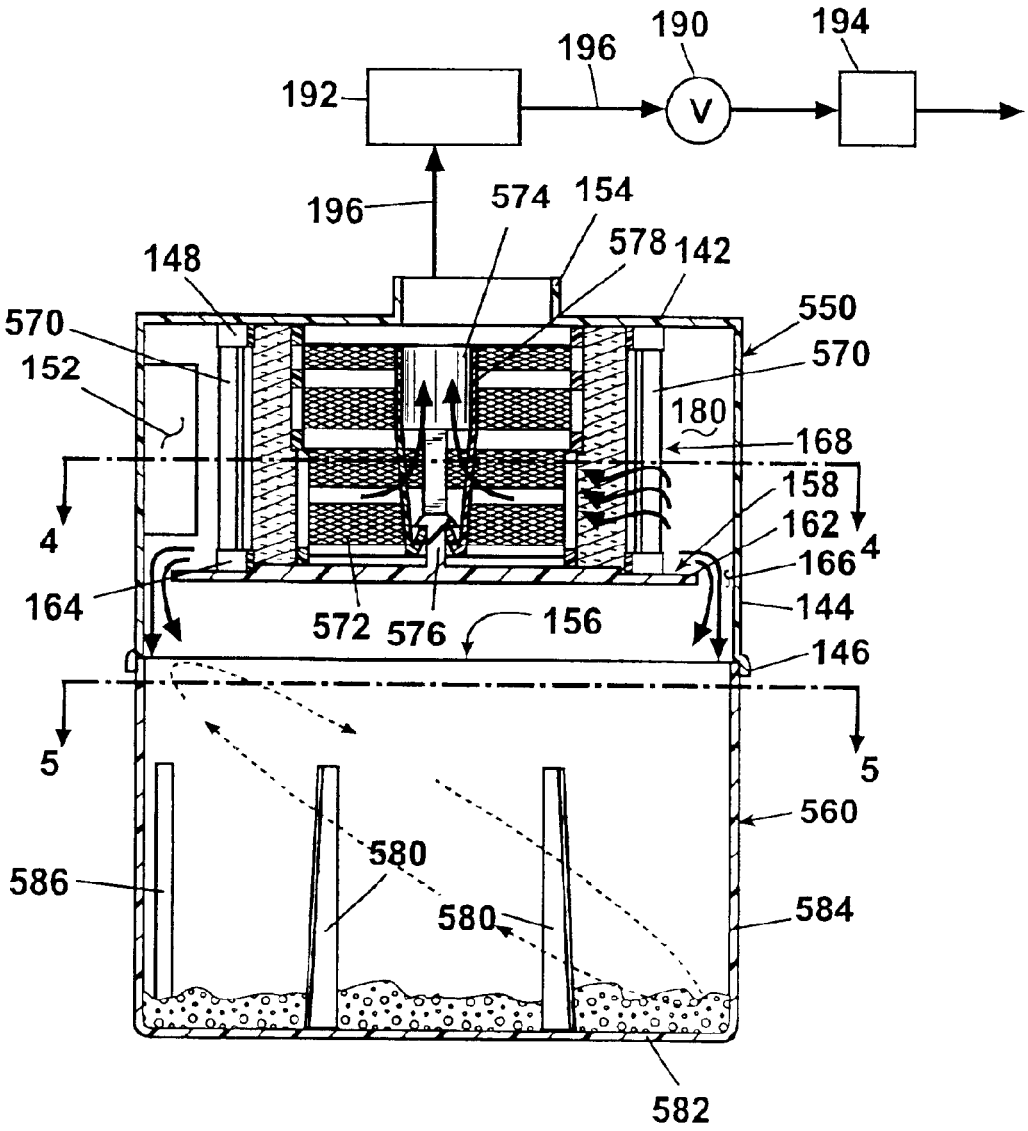
FIG. 3 is a front cross-sectional view of the cyclonic separator of FIGS. 1–2.
Figure 4:
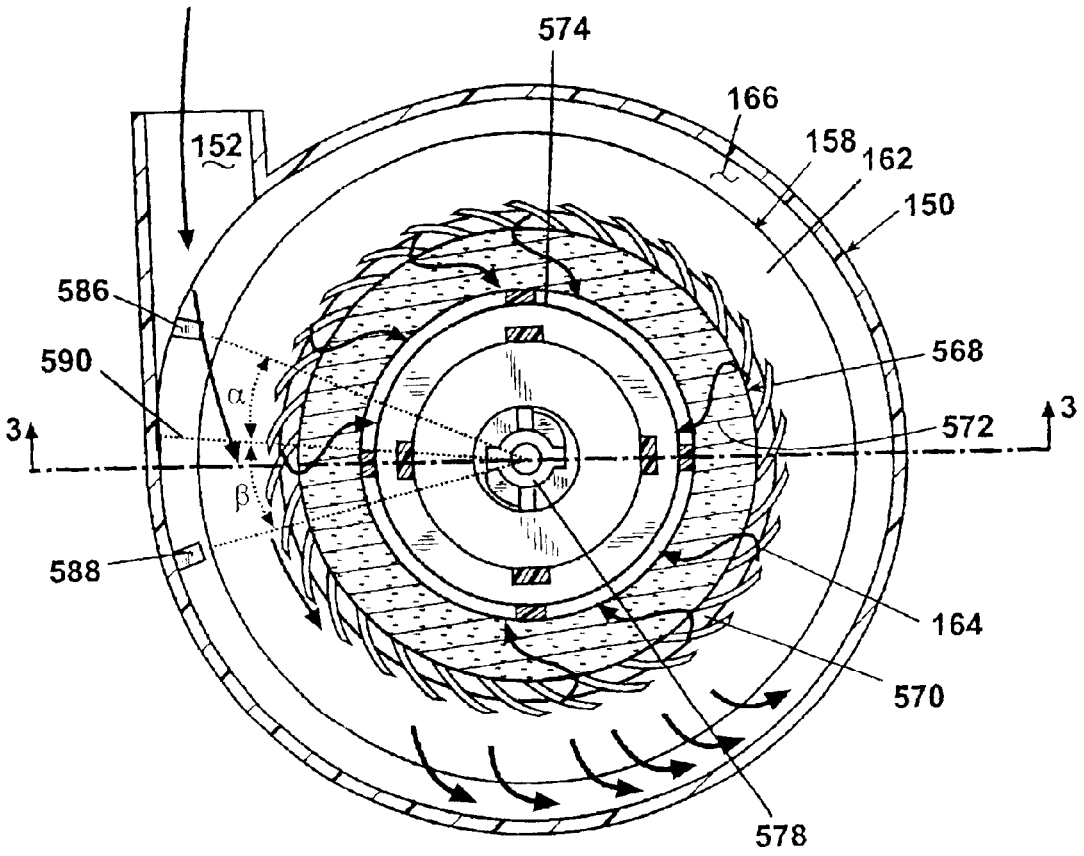
FIG. 4 is a cross-sectional view taken through line 4—4 of FIG. 3.

Referring to FIGS. 3–4, a thick-walled cylindrical foam-type filter element 572 is arranged within the cylinder formed by louvers 570 and is held in place by a filter cage 574. The filter cage 574 includes a perforate cylindrical wall formed on a solid separator plate 158, and includes a centrally disposed locking insert 576 projecting upwardly within the cylinder of the wall for mounting the cage 574 to the cyclone separator 550. A filter cage mounting projection 578 depends from upper wall 142 of cyclone separator 550, within the cylinder formed by louvers 570, to cooperate with locking insert 576 for mounting cage 574 to cyclonic dirt separator 550 in a substantially sealing fashion. The foam-type filter element 572 is thereby retained between the cage 574 and the louvers 570. Any air passing from cyclone separator 550 to exhaust outlet 154 must thereby pass through foam-type filter element 572.

Also in this manner, separator plate 158 is suspended from upper wall 142, forming a toroidal chamber 180 between the cylindrical arrangement of louvers 570 and the sidewall 144, and between the upper wall 142 and the separator plate 158, respectively. In the preferred embodiment, air inlet 152 is vertically aligned between upper wall 142 and separator plate 158 such that the tangential airflow generated from tangential air inlet 152 is directed into the toroidal chamber 180.

With further reference to FIGS. 2–4, the tangential airflow, containing particulate matter, passes through tangential air inlet 152 and into toroidal chamber 180 to travel around the filter assembly 568. As the airflow travels about the toroidal chamber 180, heavier dirt particles are forced toward sidewall 144. These particles fall under the force of gravity through a gap 166 defined between an edge 162 of separator plate 158 and the sidewall 144. Referring particularly to FIG. 3, dirt particles falling through the gap 166 drop through the open end 156 of separator 550 and are collected in the dirt cup 560. The upper end of dirt cup 560 is received in a nesting relationship in lower offset lip 146 of the sidewall 144 to seal the cyclone separator 550 to the dirt cup 560. Dirt cup 560 thereby performs the function of collecting the dirt separated from the airflow within the cyclone separator 550.

As the inlet air traverses through toroidal chamber 180, casting dirt particles toward sidewall 144, the inlet air will be drawn inwardly between louvers 570. As seen in FIG. 4, louvers 570 are oriented away from the direction of air flow (indicated by arrows) about toroidal chamber 180. The velocity of the air flow is altered as the air flow changes direction to pass around and between louvers 570. This change in the velocity of the air flow causes it to shed additional dirt particles. These dirt particles are urged toward the gap 166 by the circulating air flow in cyclone separator 550.

The portion of the air flow that passes between louvers 570 then passes through the foam-type filter element 572, which is composed to filter dirt of a selected particle size. The air then flows through exhaust outlet 154, exhaust/suction conduit 196, through a secondary (pre-motor) filter 192 to the suction source 190. The secondary filter 192 removes additional particulate matter from the exhaust airstreams prior to the airstreams being drawn through the suction source 190. A post-motor filter 194 can also be provided downstream of the suction source 190 to remove additional fine particulate matter from the exhaust airstream before it is released to the atmosphere.

Referring now to the dirt cup 560 shown in FIGS. 2–5, dirt cup 560 is formed with a generally planar bottom wall 582 and an upstanding cylindrical sidewall 584 to form an open-topped receptacle. A plurality of upstanding prongs or fingers 580 project upwardly from bottom wall 582. The fingers 580 can function in varying arrangements, but in the preferred embodiment are arranged generally symmetrically about a circle concentric with sidewall 584. The fingers 580 are further found to function best when displaced at least some distance from the center of the dirt cup 560. Each of the fingers 580 are shown as being generally rectangular in plan view, having a long axis of its plan cross-section aligned with a radius of the circle. The fingers 580 can be of uniform cross-section from top to bottom, or can have a tapering cross-section as depicted in FIG. 3, wherein the fingers 580 are narrower at the top and wider at the base where they join the bottom wall 582. The fingers 580, as shown in the FIGS. 2–3, are approximately one half the height of the dirt cup 560. Increasing the height of fingers 580 is preferred, but can be limited by production and tooling constraints and, as will be further described, the need to be able to detach dirt cup 560 from cyclone separator 550.

Figure 5:
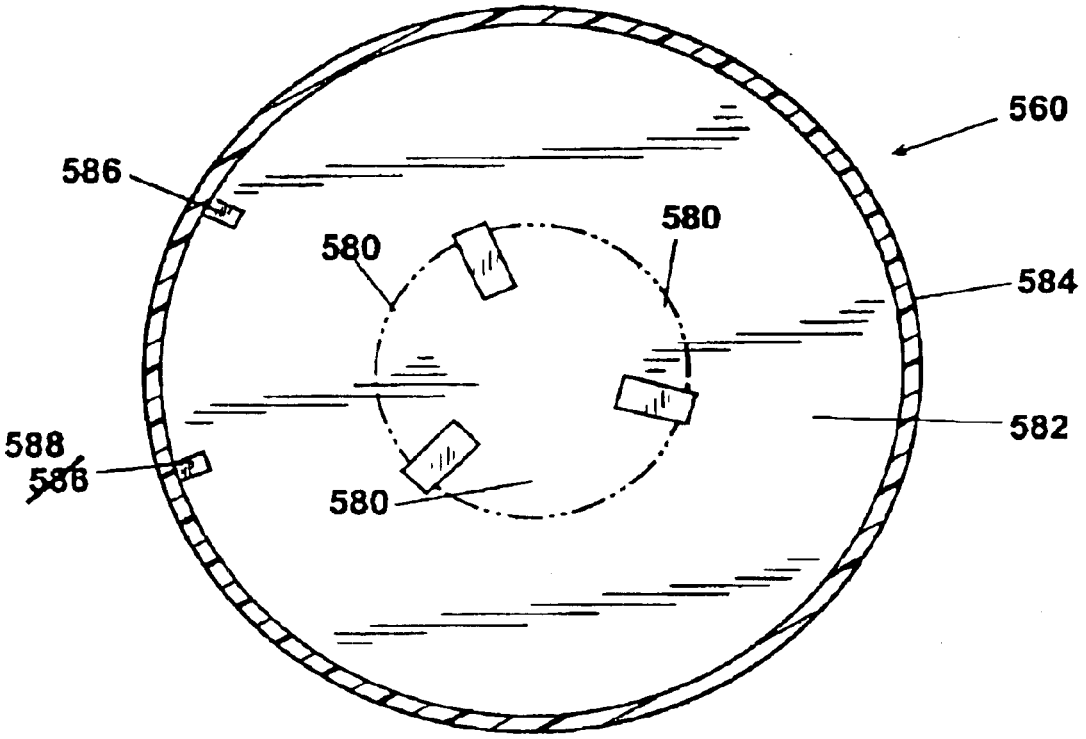
FIG. 5 is a cross-sectional view taken through line 5—5 of FIG. 3.

The dirt cup 560 further includes a pair of fins 586, 588 affixed to and contiguous with sidewall 584. Fins 586, 588 are generally rectangular in cross-section, in plan view, projecting inwardly from sidewall 584 toward a center of dirt cup 560. The distance fins 586, 588 project from sidewall 584 can range from 2% to 10% of the radius, but is preferably 3% to 6% of the radius, and optimally 4% of the radius of the dirt cup 560. Fins 586, 588 extend generally upwardly from bottom wall 582 of dirt cup 560. In the preferred embodiment, fins 586, 588 are perpendicular to bottom wall 582 and extend approximately one-half of the height of dirt cup 560, although fins 586, 588 can vary in height from 40% to 60% of the distance from bottom wall 582 to separator plate 158 and still be effective. Also in the preferred embodiment, fins 586, 588 are generally aligned in the direction of inlet airflow entering cyclone chamber 150 through air inlet 152. As shown in FIG. 5, fins 586, 588 are arranged with respect to a radial 590 perpendicular to the tangential alignment of inlet 152, with fin 586 angularly displaced from radial 590 by angle cc and fin 588 displaced from radial 590 by angle β. These angles can vary over a range of about 10° to 45°, and preferably in the range of 15° to 25°. It has been found that a satisfactory placement of the fins results when the angle α is about 19° to 20° and the angle β is about 19° to 20°.

A known phenomenon in cyclone separators is the re-entrainment of dirt into the cyclonic airflow after it is apparently deposited in a dirt containment vessel positioned beneath the cyclone chamber. It has been discovered that this re-entrainment is due to the vertical component of air circulation within the dirt cup between the gap 166 at one side of the dirt-collecting bin and the bottom wall 582 at an opposite side of the dirt-collecting bin. Generally, the airflow pattern has the strongest vertical component at the bottom portion of the dirt-collecting bin 560 below the inlet 152 to the cyclone chamber 550. This air circulation is shown in phantom lines in FIG. 3.

These vertical components of the air circulation are manifested in the "vacillating" of the dirt deposited within the dirt cup 560. Disruption of, or a decrease in the magnitude of, these vertical components or vectors serves to minimize the re-entrainment of dirt in the cyclonic airflow and agglomeration of the dirt in the dirt cup. Disruption of the airflow tends to agglomerate the dirt particles in the dirt cup 560, forming clumps or balls unlikely to be re-entrained. It has been found that fingers 580 and fins 586, 588 function in concert to inhibit the vacillation of the debris deposited in dirt cup 560, disrupting the elliptical vectors that generate upward currents that would tend to carry the smaller dirt particles upwardly and back into the cyclonic air flow. Fingers 580 further deflect dirt particles within the dirt cup 560 to further encourage agglomeration of the dirt particles. Fingers 580 are generally arranged symmetrically about dirt cup 560, but have been found to cooperate with fins 586, 588 optimally when none of fingers 580 are directly aligned with either of fins 586, 588.

Dirt cup 560 is removably connected to separator 550. Dirt cup 560 is generally vertically adjustable relative to cyclone separator 550, such as by a cam mechanism on a vacuum cleaner, so that it can be raised into an engaged and operative position underneath the cyclone separator 550. Upper edge of sidewall 584 is received within offset lip 146, which prevents dirt cup 560 from being dislodged from cyclone separator 550. To remove dirt cup 560 from cyclone separator 550, such as to discard accumulated dirt, dirt cup 560 is displaced downwardly from cyclone separator 550. Once disengaged from offset lip 146, dirt cup 560 can be removed from separator 550.

While the invention has been specifically described in connection with certain specific embodiments thereof, it is to be understood that this is by way of illustration and not of limitation. Reasonable variation and modification are possible within the forgoing disclosure and drawings without departing from the spirit of the invention which is defined in the appended claims.

What is claimed is:

1. A vacuum cleaner comprising:

a housing defining a cyclonic airflow chamber for separating contaminants from a dirt-containing airstream, said housing further comprising a cyclonic chamber inlet and an airstream outlet in fluid communication with said cyclonic airflow chamber;

a nozzle housing including a suction opening, said suction opening being fluidly connected with said cyclonic chamber inlet;

an airstream suction source fluidly connected to said main suction opening and to the cyclonic airflow chamber for transporting dirt-containing air from the main suction opening to the cyclonic airflow chamber, said suction source is adapted to establish and maintain a dirt-containing airstream from said main suction opening to said cyclonic chamber inlet;

a dirt-collecting bin mounted beneath said cyclonic airflow chamber, the dirt-collecting bin comprising a bottom wall and a sidewall;

a separator plate between the cyclonic airflow chamber and the dirt-collecting bin and separating the cyclonic airflow chamber from the dirt-collecting bin, the separator plate having a diameter less than a diameter of the cyclonic airflow chamber adjacent the separator plate to thereby define a gap between the separator plate and the cyclonic airflow chamber for passage of dirt separated from the dirt-containing airstream in the cyclonic airflow chamber whereby the passage of dirt through the gap is accompanied by airflow pattern having horizontal and vertical components between the gap at one side of the dirt-collecting bin and the bottom wall at an opposite side of the dirt-collecting bin, which airflow tends to entrain dirt particles therein; and airflow inhibitors in the dirt-collecting bin to reduce the vertical component of an elliptical airflow, thereby tending to agglomerate and separate the dirt particles from the elliptical airflow.

2. The vacuum cleaner according to claim 1 wherein the airflow inhibitors comprise at least one prong extending upwardly from the bottom wall of the dirt-collecting bin and positioned radially between a center of the dirt-collecting bin and the sidewall thereof.

3. The vacuum cleaner according to claim 2 wherein there are a plurality of said prongs each positioned radially between a center of the dirt-collecting bin and the sidewall thereof.

4. The vacuum cleaner according to claim 3 wherein the prongs extend a portion of the distance between the bottom wall and the separator plate.

5. The vacuum cleaner according to claim 3 wherein the prongs are rectangular in cross section.

6. The vacuum cleaner according to claim 5 wherein the prongs in cross-section have a long axis that is radially disposed in the dirt-collecting bin.

7. The vacuum cleaner according to claim 3 wherein the prongs are equal- angularly spaced about the bottom wall of the dirt-collecting bin.

8. The vacuum cleaner according to claim 3 wherein the airflow inhibitors further comprise at least one fin that extends radially inwardly from the sidewall of the dirt-collecting bin.

9. The vacuum cleaner according to claim 2 wherein the airflow inhibitors further comprise at least one fin that extends radially inwardly from the sidewall of the dirt-collecting bin.

10. The vacuum cleaner according to claim 9 wherein there are two and only two fins.

11. The vacuum cleaner according to claim 10 wherein the fins are generally positioned vertically below the inlet.

12. The vacuum cleaner according to claim 9 wherein the at least one fin is positioned vertically below the inlet.

13. The vacuum cleaner according to claim 12 wherein the at least one fin extends a portion of the distance between the bottom wall and the separator plate.

14. The vacuum cleaner according to claim 13 wherein the at least one fin extends between 40% and 60% of the distance between the bottom wall and the separator plate.

15. The vacuum cleaner according to claim 9 wherein the fins have a radial dimension between 2% and 10% of the radius of the dirt-collecting bin.

16. The vacuum cleaner according to claim 9 wherein the fins have a radial dimension between 3% and 6% of the radius of the dirt-collecting bin.

17. The vacuum cleaner according to claim 9 wherein the fins have a radial dimension equal to about 4% of the radius of the dirt-collecting bin.

18. The vacuum cleaner according to claim 1 wherein the airflow inhibitors comprise at least one fin that extends radially inwardly from the sidewall of the dirt-collecting bin.

19. The vacuum cleaner according to claim 18 wherein there are two and only two fins.

20. The vacuum cleaner according to claim 19 wherein the fins are generally positioned vertically below the inlet.

21. A vacuum cleaner The vacuum cleaner according to claim 19 wherein the fins extend a portion of the distance between the bottom wall and the separator plate.

22. The vacuum cleaner according to claim 19 wherein the fins have a radial dimension between 2% and 10% of the radius of the dirt-collecting bin.

23. The vacuum cleaner according to claim 22 wherein the fins have a radial dimension between 3% and 6% of the radius of the dirt-collecting bin.

24. The vacuum cleaner according to claim 23 wherein the fins have a radial dimension equal to about 4% of the radius of the dirt-collecting bin.

25. The vacuum cleaner according to claim 18 wherein the at least one fin is positioned generally below the inlet.

26. The vacuum cleaner according to claim 18 wherein the at least one fin extends a portion of the distance between the bottom wall and the separator plate.

* * * * *